US005421368A

United States Patent [19]

Maalouf et al.

[11] Patent Number: 5,421,368

[45] Date of Patent: Jun. 6, 1995

[54] REED VALVE WITH TAPERED LEG AND DUAL RADIUS VALVE STOP

[75] Inventors: Fadi S. Maalouf, Fayetteville; Michael N. Mantooth, Liverpool, both of N.Y.

[73] Assignee: Carrier Corporation, Syracuse, N.Y.

[21] Appl. No.: 300,010

[22] Filed: Sep. 2, 1994

[51] Int. Cl.[6] ..... F16K 15/16

[52] U.S. Cl. ..... 137/856

[58] Field of Search ..... 137/856

[56] References Cited

U.S. PATENT DOCUMENTS

| | | | |
|---|---|---|---|
| 1,029,726 | 6/1912 | Sprado . | |
| 1,480,608 | 1/1924 | Gardner . | |
| 3,200,838 | 8/1965 | Sheaffer | 137/512.15 |
| 3,994,319 | 11/1976 | Airhart | 137/855 |
| 4,082,295 | 4/1978 | Bainard | 277/1 |
| 4,083,184 | 4/1978 | Ushijima et al. | 60/293 |
| 4,778,360 | 10/1988 | Ikeda et al. | 417/571 |
| 4,901,760 | 2/1990 | Nagashima | 137/514 |
| 5,016,669 | 5/1991 | Jamieson | 137/512 |
| 5,178,183 | 1/1993 | Kim | 137/527 |
| 5,345,970 | 9/1994 | Leyderman | 137/856 |
| 5,370,156 | 12/1994 | Peracchio | 137/856 |

*Primary Examiner*—Robert G. Nilson

[57] ABSTRACT

The profile of the valve stop of a discharge valve is configured such that the portion facing the free length of the valve member has a first fixed radius portion and a second, larger fixed radius portion. The valve has a leg portion and a valve head with said leg portion tapering and widening in the direction of the valve head so as to have an increasing spring rate.

2 Claims, 3 Drawing Sheets

REED VALVE WITH TAPERED LEG AND DUAL RADIUS VALVE STOP

BACKGROUND OF THE INVENTION

In positive displacement compressors employing valves, the valve members may cycle hundreds of times per minute. Valve stops are commonly employed to protect the valve member from being overstressed by limiting movement of the valve member. For example, under liquid slugging conditions, the mass flow during a cycle is such that the valve member would be excessively displaced if a valve stop was not present. Engagement of the valve stop by the valve member can be a significant source of noise. The discharge valve stops in reciprocating and rolling piston rotary compressors have been identified as one of the major noise sources through the impact kinetic energy transmission of a discharge valve member. The impact between the valve and valve stop generates significant noise radiation at the natural frequency of the valve stop due to transmission of valve kinetic energy to the valve stop and the compressor shell, where the valve stop is excited at its natural frequency.

SUMMARY OF THE INVENTION

The discharge valve stop in reciprocating and rotary compressors has been identified as a major noise source through the impact kinetic energy transmission of a discharge valve. A primary reason for the intensity of the noise in conventional valve stop designs is that the tip of the valve member impacts the valve stop before the root does and because total valve/valve stop contact occurs, typically, during the last tenth of a millisecond of a one millisecond opening stroke. To reduce impact between the valve member and the valve stop, the valve is provided with an increasing spring rate and a profile of the valve stop is employed such that the initial impact occurs at a time when only a small amount of kinetic energy has been developed in the valve member and continues through the opening stroke of the valve member such that contact progresses from the root through the middle or leg to the head or pad of the valve member. This produces a rolling contact with a continuous contact between the valve member and stop as the valve member wraps around the stop. Because the valve has an increasing spring rate, the increased difficulty in opening, as the stiffness increases, will slow the opening of the valve. A smooth and gradual contact with a longer time interval transmits less spectrum rich energy, reduces the impact stress in the valve member, and produces a smaller valve stop deflection than a short time high velocity impact.

It is an object of this invention to reduce sound radiation in a positive displacement compressor.

It is another object of this invention to increase the maximum open height of the valve head or pad without increasing bending stresses in the leg portion of the valve.

It is an additional object of this invention to avoid exciting the natural frequency of a member producing a pure tone at a given frequency.

It is another object of this invention to have valve contact with the valve stop occur over the entire opening stroke of the valve member, thereby decreasing the impact stresses in the valve head.

It is a further object of this invention to minimize the kinetic energy transferred to the valve stop by the valve member and to maximize the time taken to transfer a given amount of kinetic energy to the valve stop. These objects, and others as will become apparent hereinafter, are accomplished by the present invention.

Basically, the valve and valve stop are designed in such a way that contact between the valve member and valve stop takes place over the entire opening stroke of the valve member and contact progresses from the root through the middle to the head of the valve member against an increasing valve stiffness.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
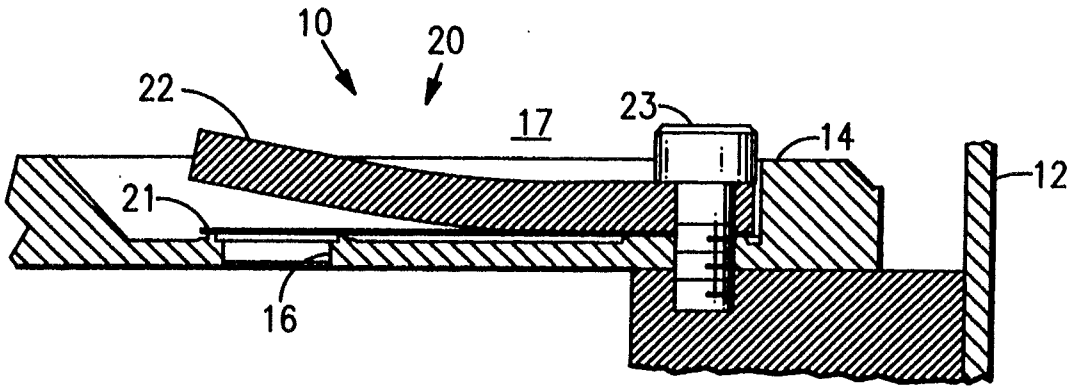
FIG. 1 is a sectional view of a discharge valve incorporating the present invention.

In FIG. 1, the numeral 10 generally designates a high side, positive displacement, hermetic compressor having a shell 12. Discharge port 16 is formed in member 14 which would be the motor side bearing end cap in the case of a fixed vane or rolling piston compressor or the valve plate of a reciprocating compressor. Also in the case of a fixed vane or rolling rotor compressor, discharge port 16 will open into a muffler to attenuate pulsations prior to flowing into the interior of shell 12. Discharge port 16 is controlled by valve assembly 20 which includes valve member 21, valve stop 22 and bolt or other fastening member 23 for securing valve member 21 and valve stop 22 to member 14.

In operation, when the pressure at discharge port 16 exceeds the pressure in chamber 17 adjacent to valve assembly 20, valve member 21 opens, by deforming or flexing, to permit flow through discharge port 16 into chamber 17. In the absence of valve stop 22, the valve member 21 would flex to a curved configuration during the discharge stroke and seat on discharge port 16 during the suction stroke. The valve stop 22 is only present to prevent excessive flexure of valve member 21, such as would happen during liquid slugging conditions, which would permanently deform the valve member 21.

Accordingly, current designs have the valve member 21 impacting the valve stop 22 during normal operation with resultant noise. This is primarily due to the fact that the valve tip strikes the valve stop before the entire leg of the valve member 21 has contacted the valve stop and that impact takes place over a small percentage of the discharge stroke. The present invention configures the valve member 21 and valve stop 22 to a shape such that impact occurs over a much larger portion of the discharge stroke with contact progressing from the root through the middle to the head of the valve member 21 as the valve member 21 wraps around the valve stop 22. This prevents the valve tip from contacting the valve stop 22 prematurely.

Figure 3:
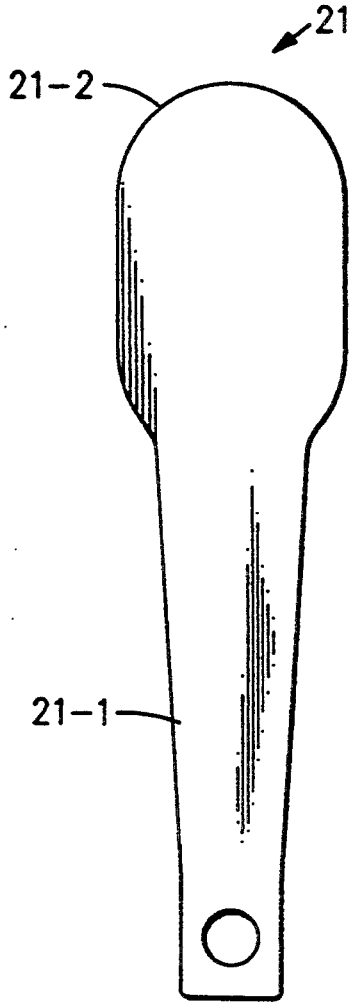
FIG. 3 is a top view of the discharge valve.

Valve member 21 is very thin, typically on the order of 0.4 mm, in its bending direction so the shear stress contribution to the resultant maximum principal stress can be neglected. Referring now to FIG. 3, valve member 21 has a tapering leg portion 21-1 which widens in the direction of the valve head 21-2. The amount of taper will be a function of the material, length of the leg, amount of opening movement an desired response. Because the leg portion 21-1 tapers, the spring rate changes and the valve member 21 becomes stiffer as you progress from the root towards the valve head 21-2. It is assumed that the stop 22 is very thick as compared with the thickness of the valve member 21 so that the valve member 21 can be considered to be clamped at the root of the stop similar to a cantilever beam. It is also assumed that the force applied on the valve head is taken as applied at the tip of a cantilever beam which corresponds to the head center of the valve member 21.

Figure 2:
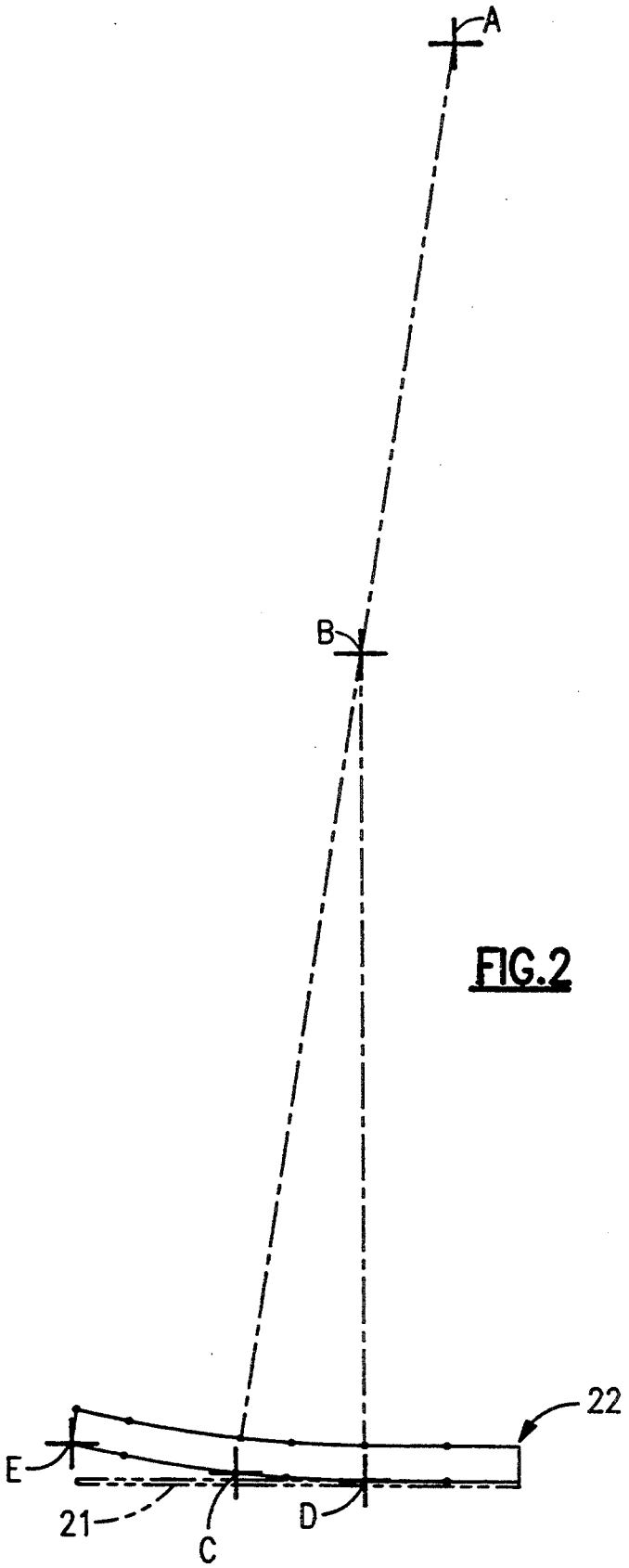
FIG. 2 is a graphic representation of the profile of the valve stop.

Turning now to FIG. 2, DCE represents the free length profile of valve stop 22 which is impacted by valve member 21. Curve DC has its center at point B and curve CE has its center at point A. Points, A, B, and C are on a straight line so that curves DC and CE are tangent at point C which results in a smooth transition between the two fixed radius curve segments which represent the leg and head portions of the valve member 21, respectively. In a typical configuration, BC is about 60% of AC and DC is 8°–15° in extent. The combination of increased contact time and reduced transferred momentum greatly suppresses the valve-valve stop vibration and radiated noise. Initial contact starts at the root and progresses continuously towards the tip of valve member 21 as leg portion 21-1 wraps around stop 22. Since contact of the valve member with the stop defines the fulcrum, opening results in a constantly reducing free length coupled with a widening of the leg portion 21-1 and the attendant stiffening of the spring rate which defines the valve member response which varies with the free length.

As compared to the present invention, a typical prior art design would have the leg portion contacting the valve stop over a radius segment corresponding to DC with the section corresponding to CE being a straight flat segment tangent to DC. This prevents bending stresses from occurring at the head portion of the valve. This, however, permits the tip of the valve to contact the valve stop before the leg of the valve has fully contacted the region corresponding to DC as the pressure is continually increased over the head of the valve during its opening cycle.

Although a preferred embodiment of the present invention has been described and illustrated, other changes will occur to those skilled in the art. For example, the valve member may be integral with additional valve members such that a plurality of separated legs extend from a common root or base and are overlain by a common valve stop. It is therefore intended that the scope of the present invention is to be limited only by the scope of the appended claims.

What is claimed is:

1. A discharge valve assembly including a valve stop and a valve member having a tip and a root with a free length therebetween which is defined by a leg portion and a valve head with said leg portion tapering and widening in the direction of said valve head so as to have an increasing variable spring rate with opening movement and said valve stop having a profile starting at said root and having a first portion which is of a first fixed radius and which transitions into a second portion which is of a second, larger fixed radius.

2. A discharge valve assembly including a valve stop having a natural frequency and a valve member movable into engagement with said stop and having a tip and a root with a free length therebetween which is defined by a leg portion and a valve head with said leg portion tapering and widening in the direction of said valve head so as to have an increasing variable spring rate with opening movement and said valve stop having a profile starting at said root and having a first portion which is of a first fixed radius and which transitions into a second portion which is of a second, larger fixed radius whereby engagement between said valve member and said stop takes place over essentially an entire opening movement of said valve member thereby maximizing the duration of, and minimizing the amount of, kinetic energy transfer from said valve member to said stop.

* * * * *